US006370738B1

(12) United States Patent
Dion, Jr.

(10) Patent No.: US 6,370,738 B1
(45) Date of Patent: Apr. 16, 2002

(54) FLEXIBLE CONDUIT TUBING SYSTEM WITHIN DISPENSER

(75) Inventor: Donald H. Dion, Jr., Churubusco, IN (US)

(73) Assignee: Tokheim Corporation, Fort Wayne, IN (US)

( * ) Notice: Subject to any disclaimer, the term of this patent is extended or adjusted under 35 U.S.C. 154(b) by 0 days.

(21) Appl. No.: 09/113,960

(22) Filed: Jul. 10, 1998

(51) Int. Cl.[7] ..... B67D 5/16
(52) U.S. Cl. ..... 22/71; 222/74; 222/320
(58) Field of Search ..... 222/40, 71, 74, 222/320

(56) References Cited

U.S. PATENT DOCUMENTS

| | | | | |
|---|---|---|---|---|
| 1,862,833 A | | 6/1932 | Stover | |
| 1,999,663 A | | 4/1935 | Paige | |
| 2,333,612 A | | 11/1943 | Zimmer | |
| 2,467,520 A | | 4/1949 | Brubaker | |
| 2,490,687 A | | 12/1949 | Guarnaschelli | |
| 2,513,115 A | | 6/1950 | Sprigg | |
| 2,541,200 A | | 2/1951 | Brubaker | |
| 3,658,154 A | | 4/1972 | Benko, Jr. | |
| 3,910,102 A | * | 10/1975 | McLean | 73/40.5 R |
| 3,915,479 A | | 10/1975 | Sotolongo | |
| 4,089,445 A | * | 5/1978 | Tatsuno | 222/538 |
| 4,131,218 A | * | 12/1978 | Tatsuno | 222/527 |
| 4,900,068 A | | 2/1990 | Law | |
| 5,099,894 A | | 3/1992 | Mozeley, Jr. | |
| 5,267,670 A | * | 12/1993 | Foster | 222/1 |
| 5,301,723 A | * | 4/1994 | Goode | 141/82 |
| 5,366,259 A | * | 11/1994 | Hohmann et al. | 285/305 |
| 5,375,887 A | | 12/1994 | Johnson | |
| 5,405,172 A | | 4/1995 | Mullen, Jr. | |
| 5,407,300 A | * | 4/1995 | Guindon et al. | 405/53 |
| 5,540,250 A | * | 7/1996 | Mullins | 137/77 |
| 5,568,946 A | * | 10/1996 | Jackowski | 285/38 |
| 5,586,586 A | * | 12/1996 | Fiech | 141/98 |
| 5,666,676 A | * | 9/1997 | Roemen et al. | 4/443 |
| 5,709,252 A | * | 1/1998 | Princiotta et al. | 141/18 |

FOREIGN PATENT DOCUMENTS

| | | | |
|---|---|---|---|
| DE | 4242244 A | 6/1994 | B60S/5/02 |

* cited by examiner

*Primary Examiner*—Joseph A. Kaufman
*Assistant Examiner*—Patrick Buechner
(74) *Attorney, Agent, or Firm*—Randall J. Knuth

(57) ABSTRACT

Flexible conduit tubing used throughout a fuel dispenser. flexible conduit separately houses wiring and supplies fuel for the operation of the dispenser. The ends of individual segments of the flexible conduit tubing contain fittings which allow easy connection and disconnection with another conduit segment or other dispenser components.

27 Claims, 2 Drawing Sheets

FLEXIBLE CONDUIT TUBING SYSTEM WITHIN DISPENSER

BACKGROUND OF THE INVENTION

1. Field of the Invention

The present invention relates to conduit tubing within a fluid dispenser, and in particular, flexible conduit tubing used within a fuel dispenser for separately housing wiring and supplying fuel.

2. Description of the Related Art

Conventional fuel dispensers are composed of various components. A typical dispenser contains a fuel supply, a fuel meter, a display, a dispenser hose and a nozzle.

Fuel enters the dispenser from the fuel supply. The fuel is delivered to the fuel meter for measuring the quantity of fuel to be dispensed. Then, the fuel continues on to the dispenser hose and out through the nozzle. Electrical wiring runs between the meter and the display which displays the quantity of fuel being dispensed. Further, electrical wiring may run through the dispenser to a fuel pump associated with the fuel supply.

Typical fuel dispensers contain conduit through which wiring and fuel run. The conduit travels between the various components within the fuel dispenser such as the fuel meter, display, fuel supply lines, and dispenser hose. It is necessary for the conduit, which houses the wiring, to prevent fluid and fuel vapor from contacting the wiring. Currently, conduit tubing is composed of copper and steel tubing.

There are several disadvantages of using copper and steel conduit tubing. The first problem with copper and steel conduit is that individual pieces of conduit tubing need to be cut to size and fit precisely. The need for precision is a direct consequence of the material being rigid and not flexible.

A second consequence of the current copper and steel conduit composition is the complexity of conduit installation within the dispenser. Conduit within a dispenser is custom-fit for each specific use, e.g. conduit running between the fuel meter and the display. A piece of conduit tubing is cut to specific lengths and is individually shaped to fit within the dispenser. In addition, separate pieces of conduit tubing are permanently joined together to form a single, continuous piece of conduit.

A third consequence of the present copper and steel conduit composition is the obsolescence of the previously cut and formed conduit tubing. Since each piece of conduit is custom-fit, if one needs to replace a piece or section of conduit, wishes to change the conduit pathway, or change the dispenser shape, new pieces of conduit tubing would need to be cut and shaped to fit within the dispenser.

SUMMARY OF THE INVENTION

According to the present invention, flexible conduit tubing is used within a fuel dispenser. The conduit separately houses wiring and supplies fuel during the operation of the dispenser.

The invention, in one form thereof, includes a dispenser cabinet in which flexible conduit is used and disposed. In a further embodiment, separate paths of flexible conduit house wiring and transmit fuel.

In another embodiment, a fitting means attaches two segments of flexible conduit to one another. In a further embodiment, a quick-connect means removably connects two segments of flexible conduit such that the two segments can be disconnected from one another and re-connected to a third segment of flexible conduit tubing. In a particular embodiment, this quick-connect means includes a fitting located at the junction of the two segments of flexible conduit tubing. The quick-connect means permits one segment of flexible conduit tubing to be quickly and easily connected, disconnected, and re-connected to a second segment of flexible conduit tubing to be quickly and easily connected and disconnected to various components within the dispenser including, for example, a meter, a display, and a fuel supply.

In yet another embodiment, the invention contains a segment of flexible conduit tubing which houses wiring for the dispenser. In one particular embodiment, a wiring connector means is used for establishing electrical conductivity between the wiring housed within the segment of conduit and the wiring within another segment of conduit or other dispenser component. In one particular embodiment, the conduit connection is vapor and fluid proof.

In a further embodiment, the flexible conduit tubing attaches to various dispenser components such as a meter or display. Electrical continuity is established between the flexible conduit tubing and the component when the flexible conduit and the component are joined. In one particular embodiment, the conduit connection is vapor and fluid proof.

An advantage of the present invention is the ease of installation of pieces of flexible conduit tubing within a fuel dispenser. The flexibility of the conduit allows for minor variations in the length and shape of the conduit tubing used throughout the dispenser. Consequently, the conduit length and shape does not need to be made as precisely as with traditional, rigid conduit.

In addition, an advantage of the present invention is the ability to change the shape of a dispenser housing without having to replace the conduit tubing enclosed. The flexible conduit can be disconnected, reconnected, bent, and extended to accommodate the new housing.

An additional advantage of the present invention is the use of the same flexible conduit tubing across varying dispenser designs or platforms. Standardized lengths of flexible conduit tubing can be joined together and shaped to form a continuous segment of flexible conduit as required for placement in varying dispenser designs.

Another advantage of one embodiment of the present invention is the simplicity of connecting conduit tubing segments together to form a single, continuous piece of conduit. This invention, in one embodiment, uses quick-connect means for easy connection and disconnection of segments from one another. The length and shape of the conduit is easily altered by adding and subtracting varying length and shape conduit tubing, as well as, bending and extending the flexible conduit tubing to alter the flexible conduit's length and shape.

A further advantage of one embodiment of the invention is the ability to re-use conduit. Unlike, traditional conduit, in which segments are permanently joined together, this invention uses fittings at the ends of the conduit segments for easy connection and disconnection.

An additional advantage of one particular embodiment, is the construction of electrically continuous conduit by simply connecting individual segments of conduit tubing together.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
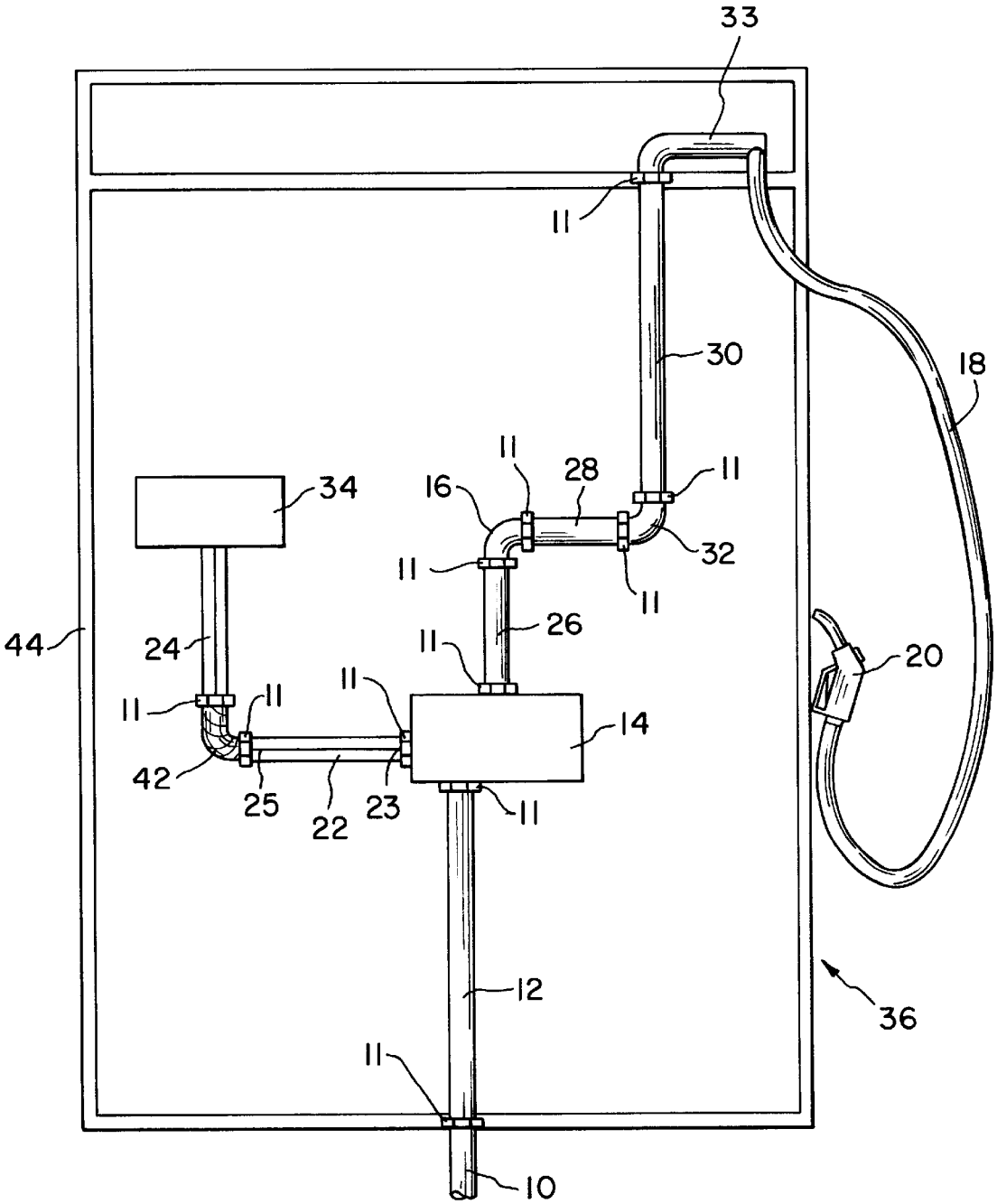
FIG. 1 is a diagram of a cross-sectional view of a fuel dispenser.

Referring now to the drawings and particularly to FIG. 1, there is shown a cross-sectional, front view of a conventional fuel dispenser with the addition of the present invention. In accordance with the present invention, dispenser cabinet 44 houses various dispenser components of dispenser 36. Such dispenser components include flexible conduit 12, 24, 25, 26, 28, 30, 32, 33, 42, meter 14, fuel supply 10 and display 34.

Flexible conduit 12, 24, 25, 26, 28, 30, 32, 33, 42 is composed of material which allows it to flex from a substantially linear configuration, such as flexible conduit 12, to a bent configuration, such as flexible conduit 32, 42. Flexible conduit 12, 24, 25, 26, 28, 30, 32, 33, 42 is composed of petroleum resistant material, for example nylon, and is fluid proof and vapor proof. Flexible conduit 12, 24, 25, 26, 28, 30, 32, 33, 42 can be-composed of other material which provides for fluid and vapor proof conduit. Other material include but are not limited to polypropylene, polyethylene, nylon composite.

Individual flexible conduit segments are joined together by quick-connection means. The quick-connection means permits a segment of flexible conduit to be removably connected to another segment of flexible conduit or other dispenser component. For example, the quick-connect means includes fitting 11 which removably connects flexible conduit 12 to meter 14. Alternately, the conduit segments may be joined by threading, compression fitting, or snap-fit insertion.

Figure 3:
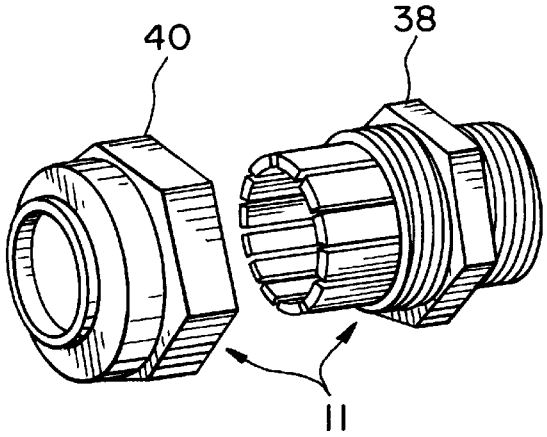
FIG. 3 is a is a diagram of a flexible conduit fitting.

Flexible conduit 12 supplies fuel from fuel supply 10 to fuel meter 14. Meter 14 measures the quantity of fuel delivered. Fitting 11 contains sealing nut 40 and compression gland 38. (best shown in FIG. 3). Fitting 11 is composed of a petroleum resistant material such as nylon and contains compression gland 38 composed of a chemically resistant material, such as TPE. Fitting 11 may also be formed of polypropylene, polyethylene, and nylon composites. Fitting 11 fits over the end of conduit 12. Tightening sealing nut 40 on compression gland 38 provides a fuel vapor and fluid tight connection. Fitting 11 permits conduit 12 to be disconnected from supply 10 and meter 14.

Flexible conduit 26 supplies fuel from meter 14 to right-angle conduit 16. Right-angle conduit 16 is a substantially rigid segment of conduit which connects flexible conduit 26 to flexible conduit 28. Fittings 11 joins right-angle conduit 16 to flexible conduit 26 and flexible conduit 28.

Flexible conduit 32 connects flexible conduit 28 to flexible conduit 30. Flexible conduit 30 attaches to flexible conduit 33 which, in turn, is connected to dispenser hose 18. Dispenser hose 18 supplies fuel to nozzle 20.

In another embodiment of this invention, a flexible wiring conduit 22 is flexible conduit which houses wiring 25 for the operation of dispenser 36. Fittings 11 located on the ends of conduit 22 is connected to meter 14 and wiring conduit 42. Fitting 11 provides a vapor and fluid proof connection. Wiring conduit 22 is attached to flexible conduit 42. Flexible conduit 42 joins wiring conduit 22 to wiring conduit 24. Wiring conduit 24 is connected to display 34. Display 34 receives signals from meter 14 and displays the fuel quantity being dispensed.

Figure 2:
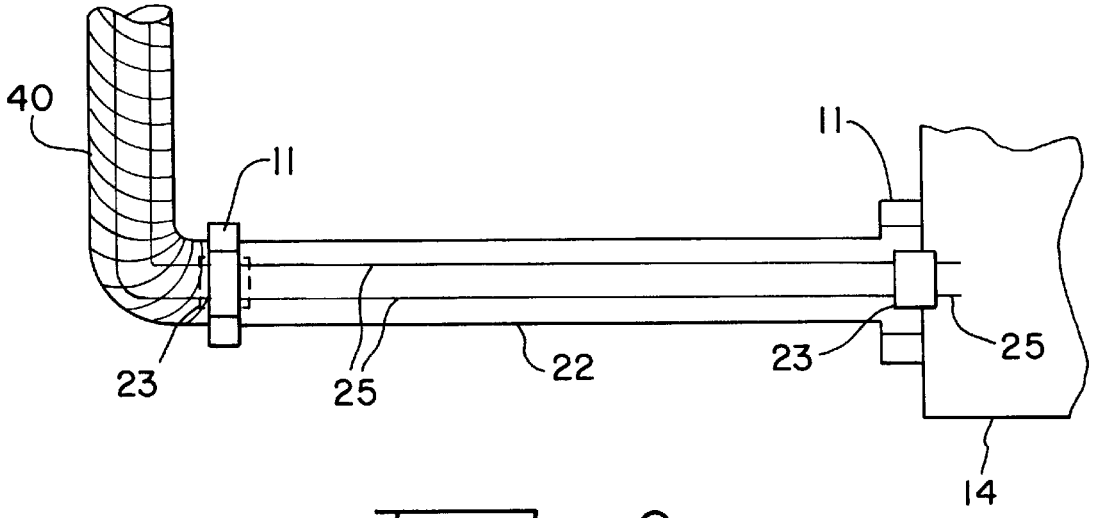
FIG. 2 is a diagram of cross-sectional view of flexible conduit.

FIG. 2 shows a cross-sectional view of a piece of conduit housing wiring for a fuel dispenser. Wiring conduit 22 also contains wiring conduit connector 23 at its ends. Wiring conduit connector 23 provides electrical continuity between wiring 25 of conduit 22 and meter 14. Similarly, wiring conduit connector 23 provide electrical continuity between wiring 25 of conduit 23 and wiring 25 of flexible connector 42. In addition, wiring conduit can be used to house dispenser wiring 25 connected to other dispenser components, e.g. a fuel pump.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for dispensing fuel, comprising:

a dispenser cabinet having a first dispenser component and a second dispenser component fixedly disposed therein; and a flexible conduit fixedly disposed between said first dispenser component and said second dispenser component, said flexible conduit located within said dispenser cabinet while not extending outside of said dispenser cabinet, said flexible conduit providing communication between said first dispenser component and said second dispenser component.

2. An apparatus according to claim 1 further comprising:

wiring housed within said flexible conduit.

3. An apparatus according to claim 1 wherein said flexible conduit is fuel and fuel vapor proof.

4. An apparatus according to claim 1, further comprising:

a first segment of said flexible conduit;

a second segment of said flexible conduit, said first segment and said second segment being fixedly disposed within said dispenser cabinet; and fitting means for attaching said first segment of conduit to said second segment of conduit.

5. The apparatus of claim 1, wherein said first dispenser component is one selected from the group comprising a meter, a display, a fuel supply, and a quick-connect means.

6. The apparatus of claim 1, wherein said second dispenser component is one selected from the group comprising a meter, a display, a fuel supply, and a quick-connect means.

7. An apparatus for dispensing fuel, comprising:

a dispenser cabinet having at least one dispenser component disposed within;

a wiring, said wiring having at least two conductors; and a flexible conduit communicatively attached to said at least one dispenser component and located within said dispenser cabinet;

said conduit housing said wiring and carrying the fuel such that said wiring and the fuel are maintained separate; and said flexible conduit not extending outside of said dispensing cabinet.

8. An apparatus according to claim 7, further comprising:

a first segment of said flexible conduit;

a second segment of said flexible conduit, said first segment and said second segment being fixedly disposed within said dispenser cabinet; and fitting means for attaching said first segment of conduit to said second segment of conduit.

9. An apparatus according to claim 8 wherein said fitting means is composed of nylon.

10. An apparatus according to claim 8 wherein said fitting means further comprises:

quick-connect means for removably connecting said first conduit segment to said second conduit segment.

11. A flexible conduit connection system for use within a fuel dispenser, comprising:

a fuel dispenser;

a first dispenser component housed within said fuel dispenser;

a first segment of flexible conduit, said first segment of flexible conduit having two ends, both ends being housed within said fuel dispenser while not extending outside of said fuel dispenser; and a first quick-connect means for removably connecting said first segment of flexible conduit to said first dispenser component.

12. A flexible conduit connection system according to claim 11 wherein said first dispenser component is a meter.

13. A flexible conduit connection system according to claim 11 wherein said first dispenser component is a display.

14. A flexible conduit connection system according to claim 11 wherein said first dispenser component is a dispenser hose.

15. A flexible conduit connection system according to claim 11 wherein said first dispenser component is a connector for connecting a plurality of fuel lines to a single fuel line.

16. A flexible conduit connection system according to claim 11 wherein said first dispenser component is a second segment of flexible conduit.

17. A flexible conduit system according to claim 11, further comprising:

a second dispenser component housed within said fuel dispenser;

said first dispense component being a meter;

said second dispenser component being a display;

said first segment of flexible conduit running between said meter and said display, said first quick-connect means removably connecting said one end of said first segment of flexible conduit to said meter; and a second quick-connect means removably connecting said other end of said first segment of flexible conduit to said display.

18. A flexible conduit system according to claim 11, further comprising:

a second dispenser component attached at an exterior surface of said fuel dispenser;

said first dispenser component being a meter;

said second dispenser component being a dispenser hose;

said first segment of flexible conduit being disposed within said fuel dispenser and running between said meter and said dispenser hose, said first quick-connect means removably connecting said one end of said first segment of flexible conduit to said meter; and a second quick-connect means for removably connecting said other end of said first segment of flexible conduit to said dispenser hose.

19. A flexible conduit system according to claim 11, further comprising:

a second dispenser component;

said first dispenser component being a meter;

said second dispenser component being a fuel supply;

said first segment of flexible conduit running between said meter and said fuel supply, said first quick-connect means removably connecting said one end of said first segment of flexible conduit to said meter; and a second quick-connect means removably connecting said other end of said first segment of flexible conduit to said fuel supply.

20. A flexible conduit connection system according to claim 11, wherein said first segment of flexible conduit supplies fuel.

21. A flexible conduit connection system according to claim 11, wherein:

said first quick-connect means provides a fluid proof and vapor proof connection.

22. A flexible conduit connection system according to claim 11, further comprising:

a first segment of wiring conduit, said first segment of wiring conduit composed of said flexible conduit;

wiring located within said first segment of wiring conduit, said wiring carrying at least two conductors;

said first dispenser component containing said wiring.

23. A flexible conduit connection system according to claim 22, wherein said first quick-connect means comprises:

a wiring connector means for connecting said wiring within said wiring conduit to said first dispenser component, wherein electrical conductivity is established between said wiring within said wiring conduit and said wiring contained in said dispenser component.

24. A flexible conduit connection system according to claim 23, wherein said first dispenser component is a meter.

25. A flexible conduit connection system according to claim 23, wherein said first dispenser component is a display.

26. A flexible conduit connection system according to claim 23, wherein said first dispenser component is a second segment of wiring conduit.

27. A flexible conduit connection system according to claim 23, wherein:

said first quick-connect means provides a fluid proof and vapor proof connection.

* * * * *